US010895126B2

(12) United States Patent
Ely

(10) Patent No.: US 10,895,126 B2
(45) **Date of Patent: *Jan. 19, 2021**

(54) METHOD FOR PREVENTING INFLUX OF FLUID DURING FRACTURING OF AN OFFSET WELL

(71) Applicant: Ely and Associates, LLC, Houston, TX (US)

(72) Inventor: John W. Ely, Montgomery, TX (US)

(73) Assignee: Ely and Associates, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/922,689

(22) Filed: Jul. 7, 2020

(65) Prior Publication Data

US 2020/0332623 A1 Oct. 22, 2020

Related U.S. Application Data

(63) Continuation of application No. 14/979,560, filed on Dec. 28, 2015, now Pat. No. 10,704,356.

(51) Int. Cl.
*E21B 33/138* (2006.01)
*E21B 43/26* (2006.01)
*E21B 29/02* (2006.01)

(52) U.S. Cl.
CPC ..... *E21B 33/138* (2013.01); *E21B 29/02* (2013.01); *E21B 43/261* (2013.01)

(58) Field of Classification Search
CPC ..... E21B 33/138; E21B 43/261
USPC ..... 166/281
See application file for complete search history.

(56) References Cited

U.S. PATENT DOCUMENTS 9,840,900 B2 * 12/2017 Snider ..... E21B 47/06

* cited by examiner

*Primary Examiner* — William D Hutton, Jr.
*Assistant Examiner* — Ashish K Varma
(74) *Attorney, Agent, or Firm* — Tumey L.L.P.

(57) ABSTRACT

Method is provided for preventing fluid from entering a well, such as a producing well, during a hydraulic fracturing treatment in another well completed in the same reservoir. Degradable ball sealers or degradable particulate material is injected into the well and pressure is maintained in the well during the fracturing treatment to prevent influx of fluid.

16 Claims, 1 Drawing Sheet

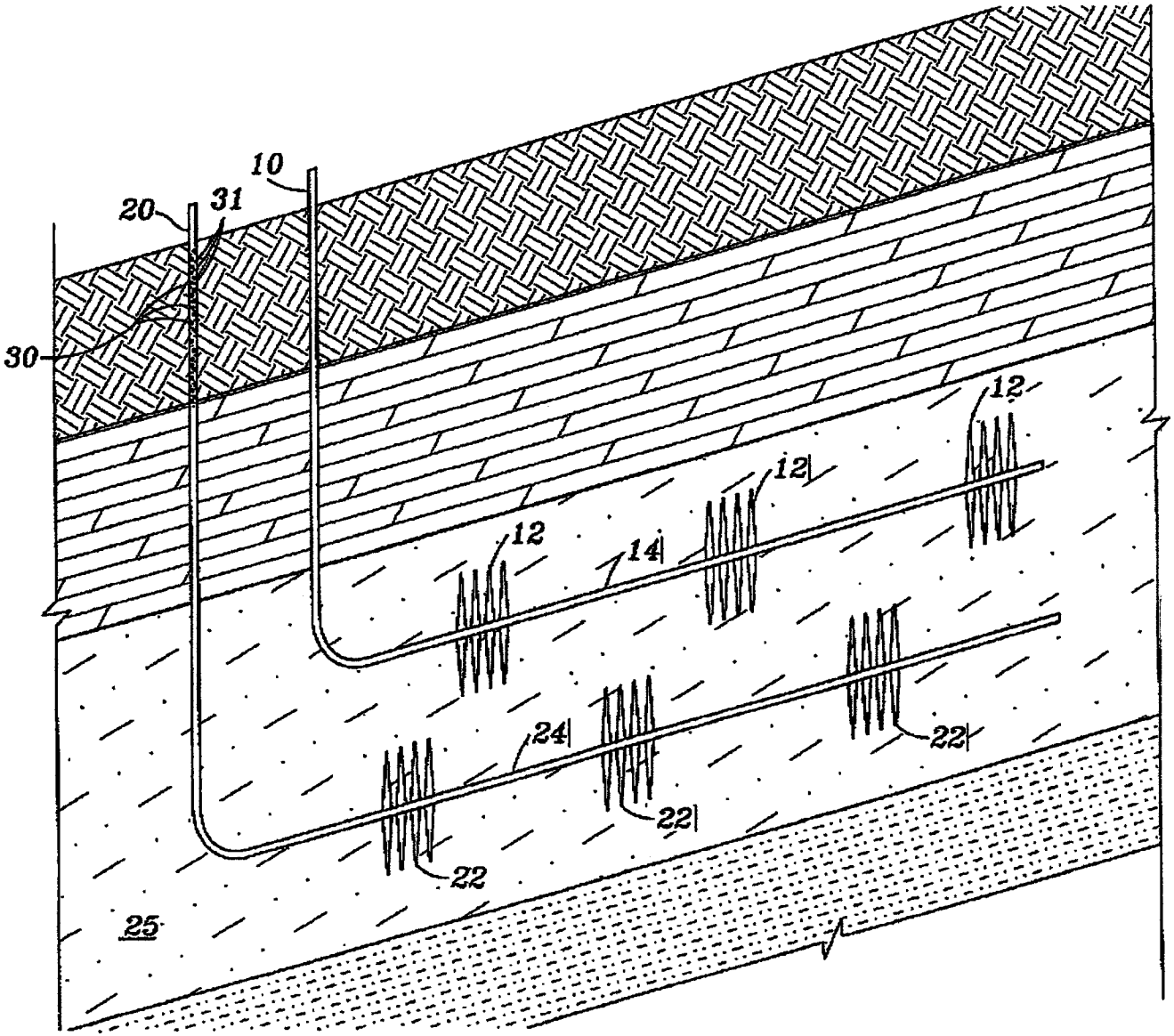
10
31
20
30
12
12
12
14
22
22
22
24
25

METHOD FOR PREVENTING INFLUX OF FLUID DURING FRACTURING OF AN OFFSET WELL

This application is a continuation of, and claims priority to, U.S. patent application Ser. No. 14/979,560 filed on Dec. 28, 2015.

BACKGROUND OF THE INVENTION

Field of the Invention

Method for improving results of hydraulic fracturing in heterogeneous reservoirs. More specifically method is provided for preventing fluid from entering a well during or soon after hydraulic fracturing of an offset well completed in the same reservoir.

Description of Related Art

Hydraulic fracturing in unconventional reservoirs has increased in many parts of the world in recent years. Large amounts of fracturing fluid may be injected into a well in an effort to open more rock to allow hydrocarbons to be produced from the reservoir. Hydraulic fractures in conventional reservoirs (that are not naturally fractured) are formed in a preferred direction and the fracturing fluid leaks from a plane in fractured rock. Fracturing fluids do not move for long distances away from the confined vertical fracture. In contrast, in unconventional reservoirs the rock is often naturally fractured and when a hydraulic fracturing treatment is performed, fracturing fluid may flow far away from the well being fractured in different directions.

It has been observed in the field that fracturing fluids from fracturing treatments in offset wells in various directions may be produced into a producing well in the same reservoir or reservoir fluids may be temporarily produced at a higher rate. This is a disadvantage, because fracturing fluid or water near the producing well may decrease production rate of hydrocarbons and may require disposal of additional water.

What is needed is a simple and inexpensive method of preventing fracturing fluid from offset wells or additional reservoir water flowing into a producing well in the same reservoir as another well is being fractured.

BRIEF DESCRIPTION OF THE DRAWING(S)

FIG. 1 is an isometric view of two horizontal wells completed in the same naturally fractured reservoir.

DETAILED DESCRIPTION OF THE INVENTION

Referring to FIG. 1, well 10 and well 20 are completed in naturally fractured reservoir 25. The wells are completed by perforations 12 in well 10 and 22 in well 20. Alternatively, openings in casings 14 and 24 may be provided by ports controlled by sliding sleeves or any other types of opening in casings 12 and 22.

The following procedure may be followed when well 10 is to be hydraulically fractured and it is desired to prevent influx of fracturing or reservoir fluid into well 20. Before injection of fracturing fluid into well 10 or soon after injection begins, degradable ball sealers 30 or degradable particles 31, or both, together or separately, may be injected into well 20 in a carrier fluid such as water or a fracturing fluid. Injection of fluid into well 20 is continued and sufficient ball sealers or degradable particles are injected to provide partial or complete shut-off of all perforations 22 in well 20, i.e., ball sealer or degradable particle injection may continue until a "ball-out" of well 20 is observed. A ball-out will be defined for purposes herein as an injection rate less than 0.1 barrels per minute. Preferably, a slow injection rate will be continued in well 20 to maintain pressure at the perforations at least above estimated reservoir pressure around the well during the fracturing treatment, so as to ensure that flow into the well does not unseat a ball or backflow particles. Alternatively, pressure in the wellbore at the perforations may be obtained above fracturing pressure to ensure that no fluid enters the well. The surface pressure may be maintained on well 20 during the hydraulic fracturing treatment of well 10 and until pressure decreases around well 10 and well 20 after the treatment. This will allow a much smaller injection of fluid into well 20 than would be required without use of the ball sealers 30 or particulate material 31 and leave a lower water saturation around producing well 20, providing a higher production rate.

Degradable ball sealers and degradable particles may be obtained from pumping service companies in the industry.

A variety of degradable materials may be used in the ball sealers or particulate material. For example, the degradable material may be a polymer that degrades in contact with water, such as a polyester. Other degradable materials such as metal degradable material that degrade under reservoir conditions are also widely available in industry.

After the hydraulic fracturing treatment is completed in well 10, production may be restarted from well 20. Ball sealers or particles 31 may degrade before being produced with production from well 20, or they may not be recovered if fully degraded. Degradation of ball sealers 30 or particles 31, however, will assure that no perforations are plugged by using ball sealers to seal perforations 22.

Although the present invention has been described with respect to specific details, it is not intended that such details should be regarded as limitations on the scope of the invention, except to the extent that they are included in the accompanying claims.

What is claimed is:

1. A method for preventing influx of fluid into a first well having casing during or immediately after the time of a hydraulic fracturing treatment of a second non-intersecting well completed in the same reservoir, comprising:

providing ball sealers comprising a degradable material;

injecting the ball sealers into the first well to plug or partially plug perforations or ports in the casing of the first well; and hydraulically fracturing the second well while maintaining pressure in the first well so as to maintain plugging or partial plugging of the perforations or ports in the first well, thereby preventing influx of fluid from the second well into the first well as a result of hydraulically fracturing the second well.

2. The method of claim 1 wherein the ball sealers are injected into the first well before or during the fracturing treatment in the second well until injection rate is less than 2 barrels per minute in the first well.

3. The method of claim 2 wherein the ball sealers are injected into the first well before or during the fracturing treatment in the second well until injection rate is less than 0.1 barrel per minute.

4. The method of claim 3 further comprising the step of injecting a fluid into the first well at a rate sufficient to maintain pressure at a perforation in the first well above an estimated pressure in the reservoir around the first well during the fracturing treatment in the second well.

5. The method of claim 3 further comprising the step of injecting a fluid into the first well at a rate sufficient to maintain pressure at a perforation in the first well above the fracturing pressure in the reservoir during the fracturing treatment in the second well.

6. The method of claim 1 further comprising the step of injecting a fluid into the first well at a rate sufficient to maintain pressure at a perforation in the first well above an estimated pressure in the reservoir around the first well during the fracturing treatment in the second well.

7. The method of claim 1 further comprising the step of injecting a fluid into the first well at a rate sufficient to maintain pressure at a perforation in the first well above the fracturing pressure in the reservoir during the fracturing treatment in the second well.

8. A method for preventing influx of fluid into a first well having casing during or immediately after the time of a hydraulic fracturing treatment of a second non-intersecting well completed in the same reservoir, comprising:

providing a particulate material comprising a degradable material;

injecting the particulate material into the first well to plug or partially plug perforations or ports in the casing of the first well; and hydraulically fracturing the second well while maintaining pressure in the first well so as to maintain plugging or partial plugging of the perforations or ports in the first well, thereby preventing influx of fluid from the second well into the first well as a result of hydraulically fracturing the second well.

9. The method of claim 8 wherein the particulate material is injected into the first well before or during the fracturing treatment in the second well until injection rate is less than 2 barrels per minute in the first well.

10. The method of claim 9 wherein the particulate material is injected into the first well before or during the fracturing treatment in the second well until injection rate is less than 0.1 barrel per minute.

11. The method of claim 10 further comprising the step of injecting a fluid into the first well at a rate sufficient to maintain pressure at a perforation in the first well above an estimated pressure in the reservoir around the first well during the fracturing treatment in the second well.

12. The method of claim 8 further comprising the step of injecting a fluid into the first well at a rate sufficient to maintain pressure at a perforation in the first well above an estimated pressure in the reservoir around the first well during the fracturing treatment in the second well.

13. The method of claim 8 further comprising the step of injecting a fluid into the first well at a rate sufficient to maintain pressure at a perforation in the first well above the fracturing pressure in the reservoir during the fracturing treatment in the second well.

14. The method of claim 8 wherein the degradable material comprises a degradable polymer.

15. The method of claim 8 wherein the degradable polymer comprises a hydrolytically degradable polymer.

16. A method for preventing influx of fluid into a first plurality of wells having casing during or immediately after the time of a hydraulic fracturing treatment of a second non-intersecting well completed in the same reservoir, comprising:

providing a particulate material comprising a degradable material;

injecting the particulate material into the first plurality of wells to plug or partially plug perforations or ports in the casings of the first plurality of wells; and hydraulically fracturing the second well while maintaining pressure in the first plurality of wells so as to maintain plugging or partial plugging of the perforations or ports in the first plurality of wells, thereby preventing influx of fluid from the second well into the first plurality of wells as a result of hydraulically fracturing the second well.

* * * * *